United States Patent [19]

Hummel et al.

[11] Patent Number: 4,696,368

[45] Date of Patent: Sep. 29, 1987

[54] METHOD OF PROTECTING VEHICLE EXHAUST SYSTEM

[75] Inventors: Gene S. Hummel; Mark L. Hummel, both of Baltimore, Md.

[73] Assignee: Humco, Inc., Baltimore, Md.

[21] Appl. No.: 839,637

[22] Filed: Mar. 14, 1986

[51] Int. Cl.[4] ..... F01N 1/02

[52] U.S. Cl. ..... 180/309; 180/287; 181/258

[58] Field of Search ..... 181/227, 239, 258; 98/2, 29; 109/1 V; 239/553.3; 180/309, 287

[56] References Cited

U.S. PATENT DOCUMENTS

| | | | |
|---|---|---|---|
| 859,414 | 7/1907 | Smith | 181/239 |
| 1,532,473 | 4/1925 | Byrne | 239/288 |
| 1,729,018 | 9/1929 | Siders | 181/239 X |
| 2,654,437 | 10/1953 | Woods | 181/239 |
| 3,009,530 | 11/1961 | Cocklin | 181/265 |
| 3,612,217 | 10/1971 | Heath | 181/227 |
| 3,675,398 | 7/1972 | Giarrizzo | 181/231 X |
| 4,113,051 | 9/1978 | Moller | 181/231 |
| 4,274,330 | 6/1981 | Witten et al. | 98/29 X |

OTHER PUBLICATIONS

J. C. Whitney & Co., Catalog No. 466B, p. 222.

*Primary Examiner*—David M. Mitchell
*Assistant Examiner*—Michael Mar
*Attorney, Agent, or Firm*—Leitner, Greene & Christensen

[57] ABSTRACT

A method of preventing access to the interior of the exhaust system of a vehicle by irreversibly installing on the tailpipe of the vehicle a tailpipe guard in the form of a heavy gauge steel tube having at one end an internal diameter which will accept the tailpipe with a relatively close fit, and having at the other end a heavy steel grating over the exhaust opening.

3 Claims, 3 Drawing Figures

FIG. 1
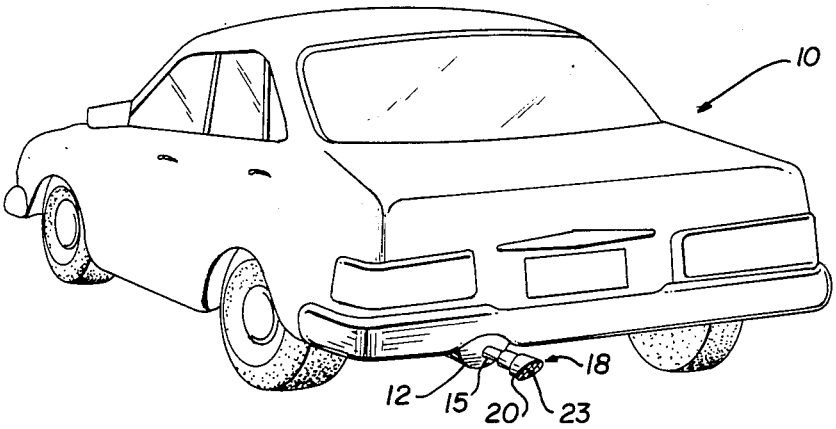
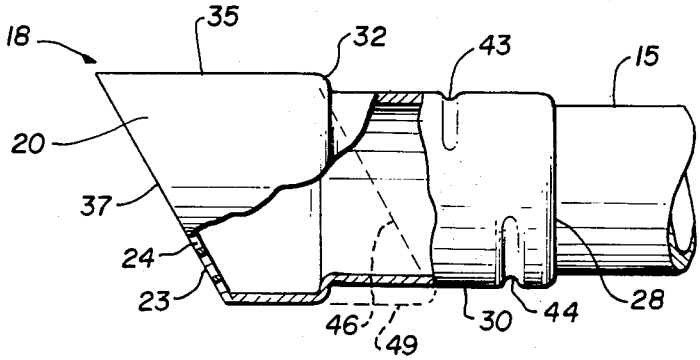
FIG. 2
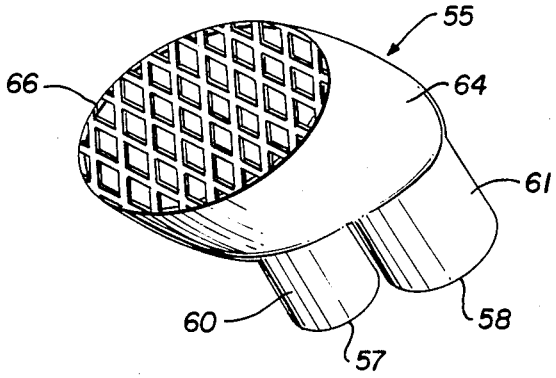
FIG. 3

METHOD OF PROTECTING VEHICLE EXHAUST SYSTEM

BACKGROUND OF THE INVENTION

1. Field of the Invention

The present invention relates generally to security devices, and more particularly to devices for protecting vehicles against sabotage.

2. Prior Art

Terrorist activities abound throughout the world, and the situation worsens with each passing year as the number and viciousness of crimes perpetrated against persons and property increasingly mounts.

One frequently employed terrorist act involves the planting of incendiary or other explosive devices in motor vehicles. Frequently such devices are placed in the vehicles engine compartment and wired to the ignition system, triggered for explosion when the vehicle's driver activates the ignition. However, various means have been provided to prevent the placement of such devices or at least to make placement substantially more difficult then was heretofore the case. For example, armored cables discourage access to the vehicles wiring; anti-theft devices trigger an audible alarm when the hood latch, trunk latch, or a door is tampered with; locking mechanisms or other restraints on vehicle hoods deter access to the engine compartment; and heavy gauge sheet metal enclosures at the underside of the engine compartment, and in some instances, the entire underside of the vehicle, discourage penetration from that sector.

By and large, the entire vehicle has been made more impenetrable in cases where the user, driver and/or passenger(s) is an individual whose position makes him or her an attractive target or attack. For example, individuals in diplomatic or foreign service, even at relatively low levels of the chain of command, are all to often subject to vandalism or harassment, if not more life-threatning terrorism. Accordingly, such individuals are now being afforded more secure vehicles or vehicles provided with devices to offer greater security to their safety. Even such areas as windshields and window glass have been improved such as by making them of transparent plastic such as Lexan or of other forms of bullet proof "glass" to prevent them from being breached.

One area of the motor vehicle that remains virtually unprotected is the exhaust system. Terrorist and other criminals have been known to thrust explosive devices into the tailpipes of vehicles, where the device is hidden from view and is triggered when the exhaust pipe reaches an elevated temperature after a few minutes of driving. In other reported instances, non-explosive objects have been forced into the tailpipe with the intent that the barrier they present to exhaust gases resulting from combustion will cause engine failure within a short period of driving, to render the occupants of the vehicle easy targets of attach in an unsecured, location; or worse, to cause the occupants of the vehicle to be overcome as the toxic fumes enter the passenger compartment.

The terrorist typically carries out a criminal act only if it can be accomplished with unimpeded dispatch. The action must be swift and sure--otherwise, the liklihood of detection of the terrorist activity or the destructive means employed weighs against going forward. On the other hand, the cost of security can rise to the level that it becomes prohibitive to afford complete protection from attack.

It is therefore a principal object of the present invention to provide a simple, relatively low cost, yet effective deterrent against a common form of sabotage of motor vehicles.

A more specific object of the present invention is to provide a simple and effective means for preventing vehicular access via the exhaust system.

SUMMARY OF THE INVENTION

The present invention provides a virtually impenetrable barrier within or at the tailpipe of an automobile or other vehicle propelled by an internal combustion engine. The invention in a preferred embodiment comprises a tailpipe guard in the form of a heavy gauge steel tube having at one end an internal diameter which will accept the tailpipe with a relatively close fit, and having at the other end a heavy gauge steel mesh enclosure over the exhaust opening. In a preferred embodiment, the tubular guard is flared to provide a larger diameter portion which terminates in the heavy mesh grating.

The guard may be secured to the tailpipe in any permanent or semi-permanent fashion. One low cost method is to crimp the two together preferably in at least two diametrically opposite locations which may be spaced along the length of the tube.

Accordingly, the invention also comprises the method of preventing access to the exhaust system of a motor vehicle via its tailpipe, by installing on the tailpipe a guard of heavy gauge steel having a first tubular portion for accepting the tailpipe with a tight fit and flaring to a second tubular portion terminating in a heavy steal grating of substantially the same gauge, and substantially permanently securing the first portion to the tailpipe.

It is of course well known to employ filter screens of various types within exhaust systems inclusing the tailpipe of vehicles, for the purpose of guarding against discharge flame particles that might ignite combustible materials outside the vehicle; or for the purpose of treating or removing noxious or toxic gases; or for the purpose of muffling exhaust system noise or heat. Such devices are described, for example, in U.S. Pats. Nos. 1,532,473 to Byrne; 3,009,530 to Cocklin; 3,675,398 to Giarrizzo; and 4,113,051 to Moller. However, none of those types of devices are intended to provide substantial security or deterrance against breach of a vehicular exhaust system for the purpose of preventing damage to the vehicle or injury to its occupants. Indeed, such prior art filter screens are either readily violated, or costly to manufacture and/or install, or both. While any of them may fortuitously avoid, for example, the thrusting of a potato into a tailpipe by a prankster, none would seriously challenge a zealot bent on disabling or destroying the vehicle by surreptitious placement of an incendiary or other explosive device within the tailpipe. Moreover, even fortuitious deterrence by such prior art devices would be at such prohibitive cost, by nature of their design and construction, as to be totally impractical for the protection of, say, a fleet of vehicles located in a geographical region suffering sporadic insurgency or terrorist activity.

Accordingly, it is still another object to the present invention to provide a tailpipe guard composed of heavy gauge metal and having an entry opening adapted to fit tightly over an existing vehicle tailpipe and an exhaust opening consisting of a similarly heavy gauge mesh integral with the tubular body of the extension.

Another object of the invention is to provide such a tailpipe guard with a flared section such that the exhaust opening is enlarged relative to the entry opening, to reduce or eliminate back pressure buildup owing to the presence of the heavy gauge grating.

Yet another object of the invention is to provide a method for installing such a tailpipe guard and securing same to the end of the tailpipe.

BRIEF DESCRIPTION OF THE DRAWINGS

The above and other objects of the invention will become apparent from a description of a preferred embodiment taken in conjuction with the accompanying drawings in which:

FIG. 1 is a perspective view of an automobile having installed thereon a tailpipe guard according to the present invention;

FIG. 2 is a side view, partly in section, of a preferred embodiment of the invention mounted on an existing tailpipe; and FIG. 3 is a perspective view of an alternative embodiment of the invention

DETAILED DESCRIPTION OF THE PREFERRED EMBODIMENTS

Referring now to FIG. 1, an automobile 10 has an exhaust system terminating in a muffler 12 and tailpipe 15. A tailpipe guard 18 according to the present invention is securely mounted on tailpipe 15 in a manner to be described presently. Tailpipe guard 18 has a tubular body 20 terminating in an exhaust opening enclosed by a metal grate 23.

Although FIG. 1 and much of the ensuing description is directed to use of the invention on an automobile, it will be recognized that the invention is not so limited. Instead it may be employed on any vehicle having an exhaust system for venting the products of combustion from an internal combustion engine.

Referring now to FIG. 2, the existing tailpipe 15 is completely conventional, although rather than the straight pipe design shown in FIG. 2, it may be curved in a downward or sideward manner. Tailpipe 15 may be of any customary diameter, as the particular diameter is not significant to the invention except in respect to the internal diameter of the tailpipe guard to provide a tight fit with the end of the existing tailpipe.

The preferred embodiment of tailpipe guard 18 has a tubular body 20 composed of heavy gauge steel or stainless steel, for example 16 gauge. At the end 28 of body 20 adapted to receive tailpipe 15, here and after sometime referred to as the entry opening, the internal diameter of the tube is slightly larger than the outer diameter of tailpipe 15. For example, if the tailpipe has a diameter of 5 centimeters, which is fairly common, the entry opening 28 of body 20 may be on the order of 2 millimeters greater. This will readily accommodate mating of tailpipe guard 18 and tailpipe 15, with a close fit between the two.

Tubular portion or section 30 of body 20 is of the same inner diameter and wall thickness as entry opening 28. Preferably, the length of this portion is governed by the length of the coextensive nesting desired between tailpipe 15 and body 20. I have found that a mating section in the range from 2.5 to 10 centimeters is quite satisfactory, but it will be understood that such a range is exemplary only and that other lengths, may be selected within the concepts of my invention.

At the selected length of section 30 from entry opening 28, the tubular body 20 is preferably flared as illustrated by numeral 32, and the larger diameter portion or section 35 extends several centimeters beyond, terminating in an exhaust opening 37 which is circumscribed by heavy gauge grating 23, preferably of the same composition and wall thickness as tubular body 20. For example, if body 20 is 16 gauge steel, grating or mesh 23 is of that thickness or slightly larger. The grating is illustrated more clearly in the perspective view of FIG. 3, although the latter depicts a different embodiment of the invention.

Returning again to FIG. 2, the purpose of the flared or enlarged portion 35 is to avoid the back pressure buildup that might otherwise occur with a grating enclosure at an exhaust opening of the same diameter as entry opening 28. As a result of the larger diameter, the effective exhaust area is close to that which would exist without the mesh enclosure, and assures substantially unimpeded flow of exhaust gases from the tailpipe extension.

The grating 23 is preferably arcwelded to the body 20 along the entire periphery of its contact with exhaust opening 37 to make the body and the grating an integral structure, and thus inseparable by ordinary force. Tailpipe guard 18 is thus of one piece design and construction and readily installed on the tailpipe.

After the guard is fitted over the tailpipe and mounted thereon such that the tailpipe extends to the flared point 32, the body portion 30 is crimped in at least two places such as 43, 44, for secure retention. Crimping of the two members has been found to assure that they cannot be separated by ordinary force.

The grating 23 with its small openings 24 prevents any disabling or distructive object from being thrust into the tailpipe, but does not obstruct the flow of the exhaust gases from the pipe. An seen in FIG. 3, the openings 24 are preferably diamond shaped having its longest dimension approximately 2 millimeters, and its shortest dimension approximately 0.8 millimeters.

As shown in FIG. 2, the exhaust end 37 of the tailpipe guard may be cut at an angle to deflect the exhaust gases downward. In addition to serving that purpose, the angled configuration enlarges the opening over that size which would obtain if the body were cut along a plane normal to the axis of the tube. Hence, such a configuration further assists in preventing untoward back pressure of the exhaust gases. If the tailpipe end is itself cut at an angle, as illustrated by the dotted line 46 in FIG. 2, the flaring 32 between body portions 30 and 35 may be configured to match that contour, as illustrated by dotted line 49.

Another embodiment of the invention is shown in FIG. 3. Here, the tailpipe guard 55 is curved for decorative purposes and to deflect the exhaust gases toward the street surface when the vehicle is in operation. The embodiment of FIG. 3 has entry openings 57, 58 to accommodate juxtaposed dual tailpipes (not shown) as are found on some vehicles. The two tubular body portions 60, 61 are integral with a single tube 64 of somewhat oval cross-section. Tube 64 terminates in an integral grating 66 at the exhaust opening of the tailpipe guard.

The embodiment of FIG. 3 may in all respects be manufactured and structured in the same manner as is set forth relative to the embodiment of FIG. 2.

Although illustrative embodiments have been described as being composed of certain specific materials and as having certain specified dimensions, it will be understood that other materials and dimensions may be employed without departing from the invention. For example, if the vehicle has a curved tailpipe, then the tailpipe guard will be formed with a similar curvature so as to readily slide onto the tailpipe. It is, however, of utmost importance that the device be sufficiently rugged to withstand ordinary efforts toward rupture or removal from the tailpipe, and thus to deter penetration via the vehicle's exhaust system. It will also be appreciated that means other than crimping may be used to secure the device to the tailpipe, such other means including rivets, bolts or other fastening devices. Crimping, however, is preferred because it is both effective and a simple operation to perform.

Accordingly it is intended that the invention be limited only by the appended claims.

I claim:

1. A method of preventing acces to the interior of the exhaust system by a terrorist via the tailpipe of a vehicle having an internal combustion engine, comprising the steps of sliding a one-piece ruggedized, tight fitting tubular metal extension of at least sixteen gauge steel having an open inlet end and a ruggedized integral grate enclosure of at least 16 gauge steel at the opposite outlet end thereof, onto the tailpipe such that exhaust gases will flow from the grate during operation of the vehicle wherein the tailpipe is impervious to objects exceeding the dimensions of holes in the grate from outside the vehicle, and irreversibly securing said extension to the tailpipe by means to prevent separation thereof by other than extraordinary force.

2. The method according to claim 1, in which said means for securing the extension to the tailpipe is accomplished by crimping said extension and tailpipe together in at least one location of contact therebetween.

3. The method according to claim 1, in which the extension is flared at the end and closed by the grate, to avoid back pressure of gases owing to the presence of the grate.

* * * * *